US006942009B2

(12) United States Patent
Hong

(10) Patent No.: US 6,942,009 B2
(45) **Date of Patent: *Sep. 13, 2005**

(54) APPARATUS FOR MANUFACTURING BILLET FOR THIXOCASTING

(76) Inventor: Chun Pyo Hong, 108-502 Daerimhansuptown 1 Susaeck-dong, Eunpyung-gu, Seoul (KR)

( * ) Notice: Subject to any disclaimer, the term of this patent is extended or adjusted under 35 U.S.C. 154(b) by 155 days.

This patent is subject to a terminal disclaimer.

(21) Appl. No.: 10/455,324

(22) Filed: Jun. 6, 2003

(65) Prior Publication Data

US 2004/0211539 A1 Oct. 28, 2004

(30) Foreign Application Priority Data

Apr. 24, 2003 (KR) ..... 10-2003-25996

(51) Int. Cl.[7] ..... B22D 17/10
(52) U.S. Cl. ..... 164/312; 164/900; 164/113
(58) Field of Search ..... 164/113, 312, 164/900

(56) References Cited

U.S. PATENT DOCUMENTS

| | | | | |
|---|---|---|---|---|
| 2,932,865 A | * | 4/1960 | Ferdinand | 164/113 |
| 3,948,650 A | | 4/1976 | Flemings et al. | |
| 4,229,210 A | | 10/1980 | Winter et al. | |
| 4,465,118 A | | 8/1984 | Dantzig et al. | |
| 4,694,881 A | | 9/1987 | Busk | |
| 6,079,477 A | | 6/2000 | Woodhouse | |
| 6,432,160 B1 | | 8/2002 | Norville et al. | |
| 2003/0037900 A1 | | 2/2003 | Winterbottom | |

FOREIGN PATENT DOCUMENTS

| | | |
|---|---|---|
| EP | 0 779 119 A | 6/1997 |
| EP | 0 845 316 A1 | 6/1998 |
| FR | 2 665 654 A | 2/1992 |
| JP | 05-225826 | 3/1995 |
| JP | 06-251148 | 3/1996 |
| JP | 07-062385 | 10/1996 |
| JP | 08-055695 | 9/1997 |
| JP | 08-283947 | 5/1998 |
| JP | 08-296420 | 5/1998 |
| JP | 10-128516 | 5/1998 |
| JP | 08-314329 | 6/1998 |
| JP | 08-317313 | 6/1998 |
| JP | 09-324294 | 8/1998 |
| JP | 09-119460 | 11/1998 |
| JP | 09-126671 | 12/1998 |
| JP | 09-198698 | 2/1999 |
| JP | 11-033692 | 2/1999 |
| JP | 10-047921 | 9/1999 |
| JP | 2000-111666 | 11/2000 |
| JP | 11-155283 | 12/2000 |
| JP | 11-160487 | 12/2000 |
| JP | 11-166816 | 12/2000 |
| WO | WO 01/91945 A | 12/2001 |

* cited by examiner

*Primary Examiner*—Jonathan Johnson
*Assistant Examiner*—Len Tran
(74) *Attorney, Agent, or Firm*—Rothwell, Figg, Ernst & Manbeck

(57) ABSTRACT

Provided is an apparatus for continuously manufacturing a plurality of high-quality billets containing fine, uniform spherical particles, with improvements in energy efficiency and mechanical properties, cost reduction, convenience of casting, and shorter manufacturing time. The apparatus includes a first sleeve; a second sleeve for receiving molten metals, one end of the second sleeve being hingedly connected to one end of the first sleeve at a predetermined angle; a stirring unit for applying an electromagnetic field to an inner portion of the second sleeve; a second plunger that is inserted into the other end of the second sleeve to define the bottom of the second sleeve for receiving the molten metals and to pressurize a prepared slurry; and a first plunger that is inserted into the other end of the first sleeve, the first plunger being operated in such a manner that when the second plunger pushes the slurry toward the first plunger, the first plunger is fixed in the first sleeve, and when a billet with a predetermined size is formed, the first plunger withdraws from the billet.

14 Claims, 6 Drawing Sheets

APPARATUS FOR MANUFACTURING BILLET FOR THIXOCASTING

BACKGROUND OF THE INVENTION

This application claims the priority of Korean Patent Application No. 2003-25996, filed on Apr. 24, 2003, in the Korean Intellectual Property Office, the disclosure of which is incorporated herein in its entirety by reference.

1. Field of the Invention

The present invention relates to an apparatus for manufacturing a billet for thixocasting, and more particularly, to an apparatus for manufacturing a billet for thixocasting with a fine and uniform particle structure 2. Description of the Related Art Thixocasting is closely related to rheocasting and thus is also expressed as rheocasting/thixocasting. Rheocasting refers to a process of manufacturing billets or final products from semi-solid metallic slurries with a predetermined viscosity, through casting or forging. Thixocasting refers to a process involving reheating billets, manufactured through rheocasting, back into semi-molten slurries and casting or forging the slurries to obtain final products. Semi-solid metallic slurries consist of spherical solid particles suspended in a liquid phase in an appropriate ratio at temperature ranges of a semi-solid state. Thus, they can be transformed even by a little force due to their thixotropic properties and can be easily cast like a liquid due to their high fluidity.

Such rheocasting/thixocasting is more advantageous than general forming processes using molten metals, such as casting or forging. Because semi-solid or semi-molten metallic slurries used in rheocasting or thixocasting have fluidity at a lower temperature than molten metals, it is possible to lower the die casting temperature, thereby ensuring an extended lifespan of the die. In addition, when semi-solid or semi-molten metallic slurries are extruded through a cylinder, turbulence is less likely to occur, and thus less air is incorporated during casting. Therefore, the formation of air pockets in final products is prevented. Besides, the use of semi-solid or semi-molten metallic slurries leads to reduced shrinkage during solidification, improved working efficiency, mechanical properties, and anti-corrosion, and lightweight products. Therefore, such semi-solid or semi-molten metallic slurries can be used as new materials in the fields of automobiles, airplanes, and electrical, electronic information communications equipment.

As described above, billets manufactured by rheocasting are used in thixocasting. In conventional rheocasting, molten metals are stirred at a temperature lower than the liquidus temperature for cooling, to break up dendritic structures into spherical particles suitable for rheocasting, for example, by mechanical stirring, electromagnetic stirring, gas bubbling, low-frequency, high-frequency, or electromagnetic wave vibration, electrical shock agitation, etc.

By way of example, U.S. Pat. No. 3,948,650 discloses a method and apparatus for manufacturing a liquid-solid mixture. In this method, molten metals are vigorously stirred while cooled for solidification. A semi-solid metallic slurry manufacturing apparatus disclosed in this patent uses a stirrer to induce flow of the solid-liquid mixture having a predetermined viscosity to break up dendritic crystalline structures or disperse broken dendritic crystalline structures in the liquid-solid mixture. In this method, dendritic crystalline structures formed during cooling are broken up and used as nuclei for spherical particles. However, due to generation of latent heat of solidification at the early stage of cooling, the method causes problems of low cooling rate, manufacturing time increase, uneven temperature distribution in a mixing vessel, and non-uniform crystalline structure. Mechanical stirring applied in the semi-solid metallic slurry manufacturing apparatus inherently leads to non-uniform temperature distribution in the mixing vessel. In addition, because the apparatus is operated in a chamber, it is difficult to continuously perform a subsequent process.

U.S. Pat. No. 4,465,118 discloses a method and apparatus for manufacturing semi-solid alloy slurries. This apparatus includes a coiled electromagnetic field application unit, a cooling manifold, and a die, which are sequentially formed inward, wherein molten metals are continuously loaded down into the vessel, and cooling water flows through the cooling manifold to cool the outer wall of the die. In manufacturing semi-solid alloy slurries, molten metals are injected through a top opening of the die and cooled by the cooling manifold, thereby resulting in a solidification zone within the die. When a magnetic field is applied by the electromagnetic field application unit, cooling is allowed to break up dendritic crystalline structures formed in the solidification zone. Finally, ingots are formed from the slurries and then pulled through the lower end of the apparatus. The basic technical idea of this method and apparatus is to break up dendritic crystalline structures after solidification by applying vibration. However, many problems arise with this method, such as complicated processing and non-uniform particle structure. In the manufacturing apparatus, since molten metals are continuously supplied to form ingots, it is difficult to control the states of the metal ingots and the overall process. Moreover, prior to applying an electromagnetic field, the die is cooled using water, so that a great temperature difference exists between the peripheral and core regions of the die.

Other types of rheocasting or thixocasting known in the art are described later. However, all of the methods are based on the technical idea of breaking up dendritic crystalline structures after formation, to generate nuclei of spherical particles. Therefore, problems arise, such as those described in conjunction with the above patents.

U.S. Pat. No. 4,694,881 discloses a method for manufacturing thixotropic materials. In this method, an alloy is heated to a temperature at which all metallic components of the alloy are present in a liquid phase, and the resulting molten metals are cooled to a temperature between their liquidus and solidus temperatures. Then, the molten metals are subjected to a shearing force in an amount sufficient to break up dendritic structures formed during the cooling of the molten metals to thereby manufacture the thixotropic materials.

Japanese Patent Application Laid-open Publication No. Hei. 11-33692 discloses a method of manufacturing metallic slurries for rheocasting. In this method, molten metals are supplied into a vessel at a temperature near their liquidus temperature or 50° C. above their liquidus temperature. Next, when at least a portion of the molten metals reaches a temperature lower than the liquidus temperature, i.e., at least a portion of the molten metals begins cooling below their liquidus temperature, the molten metals are subjected to a force, for example, ultrasonic vibration. Finally, the molten metals are slowly cooled into metallic slurries containing spherical particles. This method also uses a physical force, such as ultrasonic vibration, to break up the dendrites grown at the early stage of solidification. In this regard, if the casting temperature is greater than the liquidus temperature, it is difficult to form spherical particle structures and to rapidly cool the molten metals. Furthermore, this method leads to non-uniform surface and core structures.

Japanese Patent Application Laid-open Publication No. Hei. 10-128516 discloses a casting method of thixotropic metals. This method involves loading molten metals into a vessel and vibrating the molten metals using a vibrating bar dipped in the molten metals to directly transfer its vibrating force to the molten metals. After forming a semi-solid and semi-liquid molten alloy, which contains nuclei, at a temperature range lower than its liquidus temperature, the molten alloy is cooled to a temperature at which it has a predetermined liquid fraction and then left stand from 30 seconds to 60 minutes to allow the nuclei to grow, thereby resulting in thixotropic metals. However, this method provides relatively large particles of about 100 $\mu$m and takes a considerably long processing time, and cannot be performed in a vessel larger than a predetermined size.

U.S. Pat. No. 6,432,160 discloses a method for making thixotropic metal slurries. This method involves simultaneously controlling the cooling and the stirring of molten metals to form the thixotropic metal slurries. In detail, after loading molten metals into a mixing vessel, a stator assembly positioned around the mixing vessel is operated to generate a magnetomotive force sufficient to rapidly stir the molten metals in the vessel. Next, the molten metals is rapidly cooled by means of a thermal jacket, equipped around the mixing vessel, for precise temperature control of the mixing vessel and the molten metals. During cooling, the molten metals are continuously stirred in a manner such that when the solid fraction of the molten metals is low, a high stirring rate is provided, and when the solid fraction increases, a greater magnetomotive force is applied.

Most of the aforementioned conventional rheocasting and thixocasting methods and apparatuses use shear force to break dendritic structures into spherical structures during a cooling process. Since a force such as vibration is applied after at least a portion of the molten metals is cooled below their liquidus temperature, latent heat is generated due to the formation of initial solidification layers. As a result, there are many disadvantages such as reduced cooling rate and increased manufacturing time. In addition, due to a non-uniform temperature between the inner wall and the center of the vessel, it is difficult to form fine, uniform spherical metal particles. Therefore, this structural non-uniformity of metal particles will be greater if the temperature of the molten metals loaded into the vessel is not controlled.

In order to solve these problems, the present inventor filed Korean Patent Application No. 2003-13516, titled "Method and apparatus for manufacturing billet for thixocasting".

SUMMARY OF THE INVENTION

The present invention provides an apparatus for manufacturing a billet for thixocasting, with a fine, uniform spherical particle structure, with improvements in energy efficiency and mechanical properties, cost reduction, convenience of casting, and shorter manufacturing time.

The present invention also provides an apparatus for continuously manufacturing a plurality of high-quality billets for thixocasting within a short time.

According to an aspect of the present invention, there is provided an apparatus for manufacturing a billet for thixocasting, the apparatus comprising: a first sleeve; a second sleeve for receiving molten metals, one end of the second sleeve being hingedly connected to one end of the first sleeve at a predetermined angle; a stirring unit for applying an electromagnetic field to an inner portion of the second sleeve; a second plunger that is inserted into the other end of the second sleeve to define the bottom of the second sleeve for receiving the molten metals and to pressurize a prepared slurry; and a first plunger that is inserted into the other end of the first sleeve, the first plunger being operated in such a manner that when the second plunger pushes the slurry toward the first plunger, the first plunger is fixed in the first sleeve, and when a billet with a predetermined size is formed, the first plunger withdraws from the billet.

According to specific embodiments of the present invention, the first sleeve may comprise an outlet vent for discharging the formed billet.

The apparatus may further comprise a cooling unit, which is installed around the first sleeve.

The stirring unit may apply the electromagnetic field to the second sleeve prior to loading the molten metals into the second sleeve. Alternatively, the stirring unit may apply the electromagnetic field to the second sleeve simultaneously with or in the middle of loading the molten metals into the second sleeve.

The stirring unit may apply the electromagnetic field to the second sleeve until the molten metals in the second sleeve have a solid fraction of 0.001–0.7, preferably 0.001–0.4, and more preferably 0.001–0.1.

The molten metals in the second sleeve may be cooled until they have a solid fraction of 0.1–0.7.

The apparatus may further comprise a temperature control element, which is installed around the second sleeve to cool the molten metals in the second sleeve. This temperature control element may comprise at least one of a cooler and a heater, which are installed around the second sleeve. The temperature control element may cool the molten metals in the second sleeve at a rate of 0.2–5.0° C./sec, preferably 0.2–2.0° C./sec.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Hereinafter, the present invention will be described in detail with reference to the accompanying drawings.

A billet manufactured according to the present invention is used for thixocasting and is manufactured by rheocasting.

In this regard, the billet manufacturing apparatus of the present invention manufactures a billet according to rheocasting. Therefore, rheocasting as performed by the apparatus of the present invention will first be described with reference to FIG. 1.

Unlike the aforementioned conventional techniques, according to rheocasting of the present invention, molten metals are loaded in a sleeve to form a slurry and then the slurry is pressurized to form a billet with a predetermined size. In this case, molten metals are stirred by applying an electromagnetic field prior to the completion of loading the molten metals into a sleeve. In other words, electromagnetic stirring is performed prior to, simultaneously with, or in the middle of loading the molten metals into the sleeve, to prevent the formation of dendritic structures. The stirring process may be performed using ultrasonic waves instead of the electromagnetic field.

In detail, after an electromagnetic field is applied to a predetermined portion of a sleeve surrounded by a stirring unit, molten metals are loaded in the sleeve. In this case, an electromagnetic field is applied in an intensity sufficient to stir molten metals.

Figure 1:
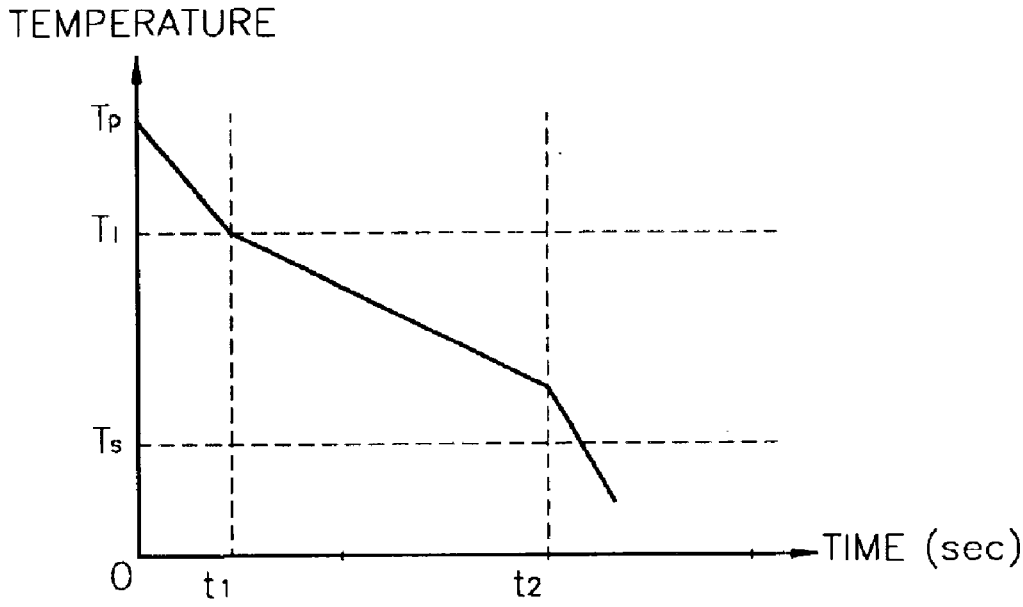
FIG. 1 is a graph of the temperature profile applied to an apparatus for manufacturing a billet for thixocasting according to the present invention.

As shown in FIG. 1, molten metals are loaded into a sleeve at a temperature Tp. As described above, an electromagnetic field may be applied to the sleeve prior to loading molten metals into the sleeve. However, the present invention is not limited to this, and electromagnetic stirring may be performed simultaneously with or in the middle of loading the molten metals into the sleeve.

Due to the electromagnetic stirring performed prior to the completion of loading molten metals into the sleeve, the molten metals do not grow into dendritic structures near the inner wall of the low temperature sleeve at the early stage of solidification. That is, numerous micronuclei are concurrently generated throughout the sleeve because all molten metals are rapidly cooled to a temperature lower than their liquidus temperature.

Applying an electromagnetic field to the sleeve prior to or simultaneously with loading molten metal into the sleeve leads to active stirring of the molten metals in the center and inner wall regions of the sleeve and rapid heat transfer throughout the sleeve. Therefore, at the early stage of cooling, the formation of solidification layers near the inner wall of the sleeve is prevented. In addition, such active stirring of the molten metals induces smooth convection heat transfer between the higher temperature molten metals and the lower temperature inner sleeve wall. Therefore, the molten metals can be rapidly cooled. Due to the electromagnetic stirring, particles contained in the molten metals scatter upon loading the molten metals into the sleeve and are dispersed throughout the sleeve as nuclei, so that only a minor temperature difference in the sleeve is caused during cooling. However, in conventional techniques, when the molten metals make contact with a low temperature inner vessel wall, solidification layers are formed near the inner wall of the vessel. Dentritic crystals are formed from the solidification layers.

The principles of the present invention will become more apparent when described in connection with latent heat of solidification. Molten metals are not solidified near the inner sleeve wall at the early stage of cooling, and no latent heat of solidification is generated. Accordingly, only the specific heat of the molten metals, which corresponds to about 1/400 of the latent heat of solidification, is required to cool the molten metals. Therefore, dendrites, which are generated frequently near the inner sleeve wall at the early stage of cooling when using conventional methods, are not formed. All molten metals in the sleeve can be uniformly cooled within merely about 1–10 seconds from the loading of the molten metals. As a result, numerous nuclei are created and uniformly dispersed throughout all molten metals in the sleeve. The increased nuclei density reduces the distance between the nuclei, and spherical particles, instead of dendritic particles, are formed.

The same effects can even be achieved even when an electromagnetic field is applied in the middle of loading the molten metals into the sleeve. In other words, solidification layers are hardly formed near the inner sleeve wall even when electromagnetic stirring begins in the middle of loading the molten metals into the sleeve.

It is preferable to limit the loading temperature, Tp, of the molten metals to a range from their liquidus temperature to 100° C. above the liquidus temperature (melt superheat= 0~100° C.). According to the present invention, since the entire sleeve containing the molten metals is uniformly cooled, there is no need to cool the molten metals to near their liquidus temperature. Therefore, it is possible to load the molten metals into the sleeve at a temperature of 100° C. above their liquidus temperature.

On the other hand, after the completion of loading molten metals into a vessel in one conventional method, an electromagnetic field is applied to a vessel when a portion of the molten metals reaches below their liquidus temperature. Accordingly, at the early stage of cooling, latent heat is generated due to the formation of solidification layers near the inner wall of the vessel. Because the latent heat of solidification is about 400 times greater than the specific heat of the molten metals, significant time is required to drop the temperature of the entire molten metals below their liquidus temperature. Therefore, in such a conventional method, the molten metals are generally loaded into a vessel after the molten metals are cooled to a temperature near their liquidus temperature or a temperature 50° C. above their liquidus temperature.

According to the present invention, the electromagnetic stirring may be stopped at any point after at least a portion of the molten metals in the sleeve reaches a temperature lower than the liquidus temperature $T_l$, i.e., after accomplishing nucleation for a solid fraction of a predetermined amount, such as about 0.001, as shown in FIG. 1. That is, an electromagnetic field may be applied to the molten metals in the sleeve throughout the cooling process of the molten metals. This is because, once nuclei are distributed uniformly throughout the sleeve, even at the time of growth of crystalline particles from the nuclei, properties of the metallic slurry are not affected by the electromagnetic stirring. Therefore, the electromagnetic stirring can be carried out until a solid fraction of the molten metals is 0.001–0.7. However, in view of energy efficiency, it is preferable to carry out the electromagnetic stirring until a solid fraction of the molten metals is in a range of 0.001–0.4, and more preferably 0.001–0.1.

After the molten metals are loaded into the sleeve to form uniformly distributed nuclei, the sleeve is cooled to facilitate the growth of the nuclei. This cooling process may be performed simultaneously with loading the molten metals into the sleeve. As described above, the electromagnetic field may be constantly applied during the cooling process.

The cooling process may be carried out until just prior to a subsequent process, i.e., billet formation process, and preferably, until a solid fraction of the molten metals is 0.1–0.7, i.e., up to time $t_2$ of FIG. 1. The molten metals may be cooled at a rate of 0.2–5.0° C./sec. The cooling rate may be 0.2–2.0° C./sec depending on a desired distribution of nuclei and a desired size of particles.

By using the aforementioned process, a semi-solid metallic slurry containing a predetermined solid fraction can be easily manufactured. The manufactured semi-solid metallic slurry is directly subjected to pressurizing and cooling to form a billet for thixocasting.

According to the aforementioned process, a semi-solid metallic slurry can be manufactured within a short time. That is, manufacturing of a metallic slurry with a solid fraction of 0.1–0.7 merely occurs within 30–60 seconds from loading the molten metals into the sleeve. The manufactured metallic slurry can be used for forming a billet having a uniform, dense spherical crystalline structure.

Figure 2:
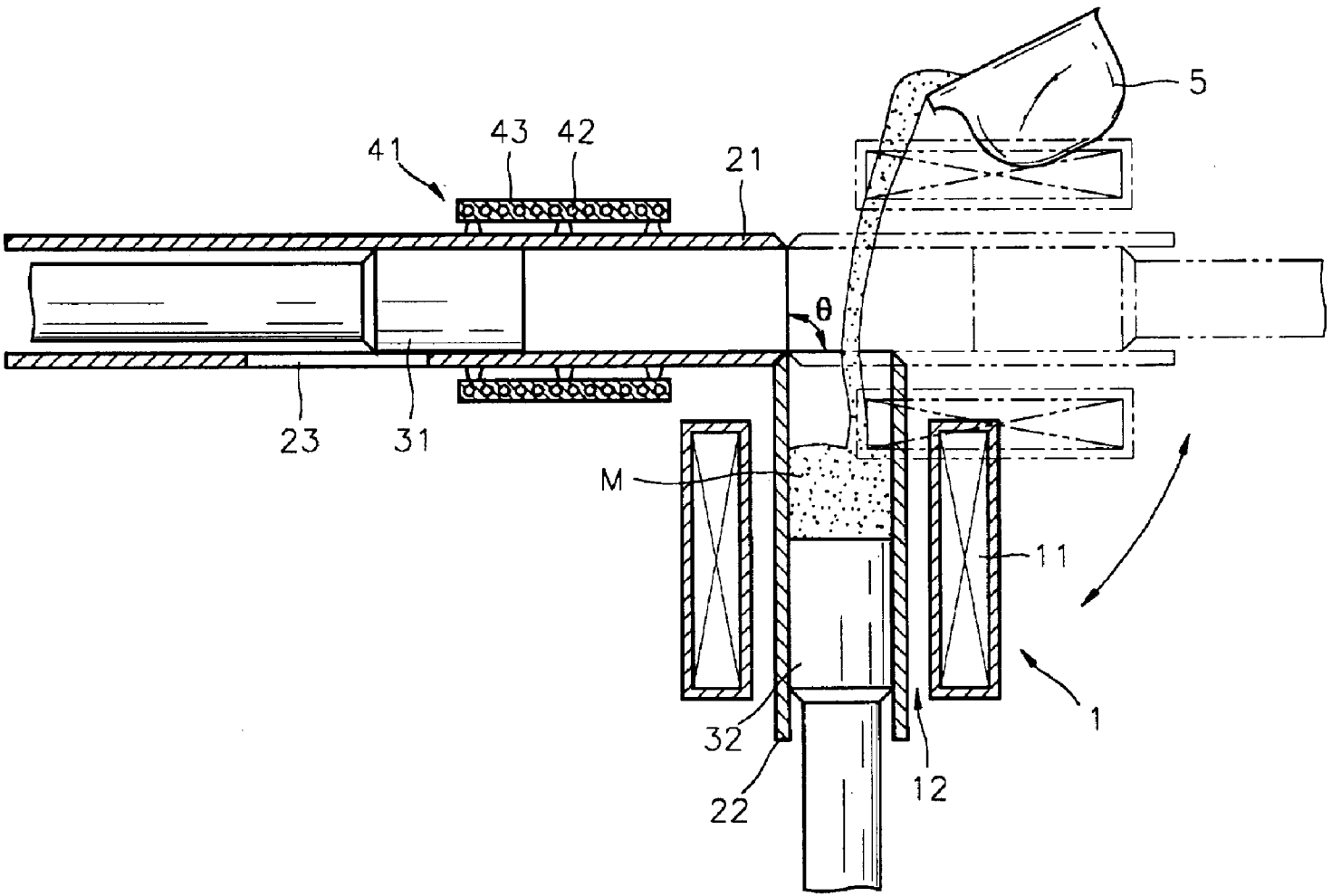
FIG. 2 illustrates the structure of an apparatus for manufacturing a billet for thixocasting according to an embodiment of the present invention.

Based on the aforementioned rheocasting process, a billet for thixocasting can be manufactured using an apparatus according to an embodiment of the present invention shown in FIG. 2.

Referring to FIG. 2, a billet manufacturing apparatus according to an embodiment of the present invention comprises a first sleeve 21 and a second sleeve 22; a stirring unit 1 for applying an electromagnetic field to the inner portion of the second sleeve 22; a first plunger 31 and a second plunger 32.

A coil 11 for applying an electromagnetic field is installed in the stirring unit 1 in such a way as to surround a space 12 defined by the stirring unit 1. The coil 11 may be supported by a separate frame (not shown). The coil 11 is used to apply a predetermined intensity of electromagnetic field to the second sleeve 22, which is accommodated in the space 12. In addition, the coil 11 is electrically connected to a controller (not shown) for electromagnetically stirring the molten metals contained in the second sleeve 22 in a controlled manner. There are no particular limitations to the coil 11, provided that the coil 11 can be used in a conventional electromagnetic stirring process. An ultrasonic stirrer may also be used.

Figure 4:
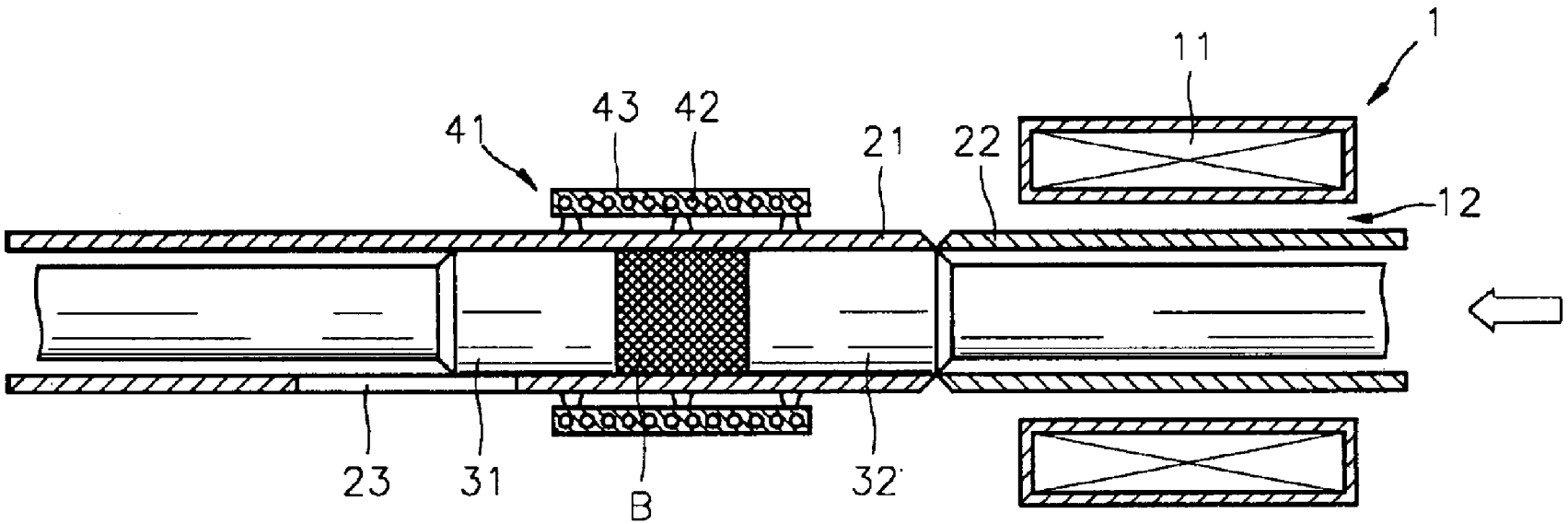
FIG. 4 illustrates a billet for thixocasting manufactured using the apparatus shown in FIG. 2.

As shown in FIG. 2, the coil 11 may be installed around the second sleeve 22 while in contact with the outside of the second sleeve 22 without leaving the space 12. By using the coil 11, molten metals M can be thoroughly stirred while being loaded into the second sleeve 22. When the second sleeve 22 moves, the stirring unit 1 may move together with the second sleeve 22, as shown in FIGS. 2 and 4.

The application of an electromagnetic field, i.e., the electromagnetic stirring by the stirring unit 1, may be sustained until a prepared semi-solid metallic slurry is pressurized. However, in view of energy efficiency, an electromagnetic field may be applied until a slurry is manufactured, i.e. until a solid fraction of the slurry is 0.001–0.7. Preferably, the application of an electromagnetic field may be carried out until a solid fraction of the slurry is 0.001–0.4, and more preferably 0.001–0.1. The time required for accomplishing these solid fraction levels can be experimentally measured.

Turning to FIG. 2, the first sleeve 21 and the second sleeve 22 have opposed ends that are hingedly connected. The second sleeve 22 can move at an angle θ, preferably, less than 90 degrees with respect to the first sleeve 21. The first and the second sleeves 21, 22 may be made of a metallic material or an insulating material. However, it is preferable to use a material having a higher melting point than the molten metals M to be loaded thereinto. The two sleeves may be connected to each other in a state wherein both ends of each sleeve are open. The first sleeve 21 is positioned parallel to the ground and the second sleeve 22 is positioned at a predetermined angle with respect to the first sleeve 21.

Under such an apparatus structure, the second sleeve 22 is an area for receiving molten metals and forming a slurry via electromagnetic stirring. On the other hand, the first sleeve 21 is an area for forming a billet using the formed slurry. That is, the second sleeve 22 acts as a slurry manufacturing vessel for manufacturing a semi-solid slurry using molten metals and the first sleeve 21 acts as a forming die for manufacturing a billet using the manufactured slurry.

For this, a first plunger 31 and a second plunger 32 are inserted into the first sleeve 21 and the second sleeve 22, respectively. As shown in FIG. 2, the second plunger 32, inserted into one end of the second sleeve 22, is used to close the end of the second sleeve 22, so that the second sleeve 22 may receive molten metals M. As will be described later, the first plunger 31 is inserted into one end of the first sleeve 21 and is fixed in the first sleeve 21 when the second sleeve 22 pushes a slurry toward the first plunger 31 to form a billet.

It is not necessary to open both ends of each of the first and the second sleeves 21, 22. There are no particular limitations to the structures of the sleeves, provided that the first and the second plungers 31, 32 are inserted into respective predetermined ends of the sleeves. Although not shown in FIG. 2, a thermocouple may be installed in each sleeve while the thermocouple is connected to a controller for providing temperature information to the controller. In addition, the first sleeve 21 may have an outlet vent 23 for discharging manufactured billets.

The apparatus of the present invention may further comprise a cooling unit 41, which is installed around the first sleeve 21, as shown in FIG. 2. The cooling unit 41 may be a water jacket 43 containing a cooling water pipe 42, but is not limited thereto. Any cooling units capable of cooling a predetermined portion of the first sleeve 21 may be used. The cooling unit 41 serves to cool a slurry pressurized by the second sleeve 22 for forming a billet.

Figure 3:
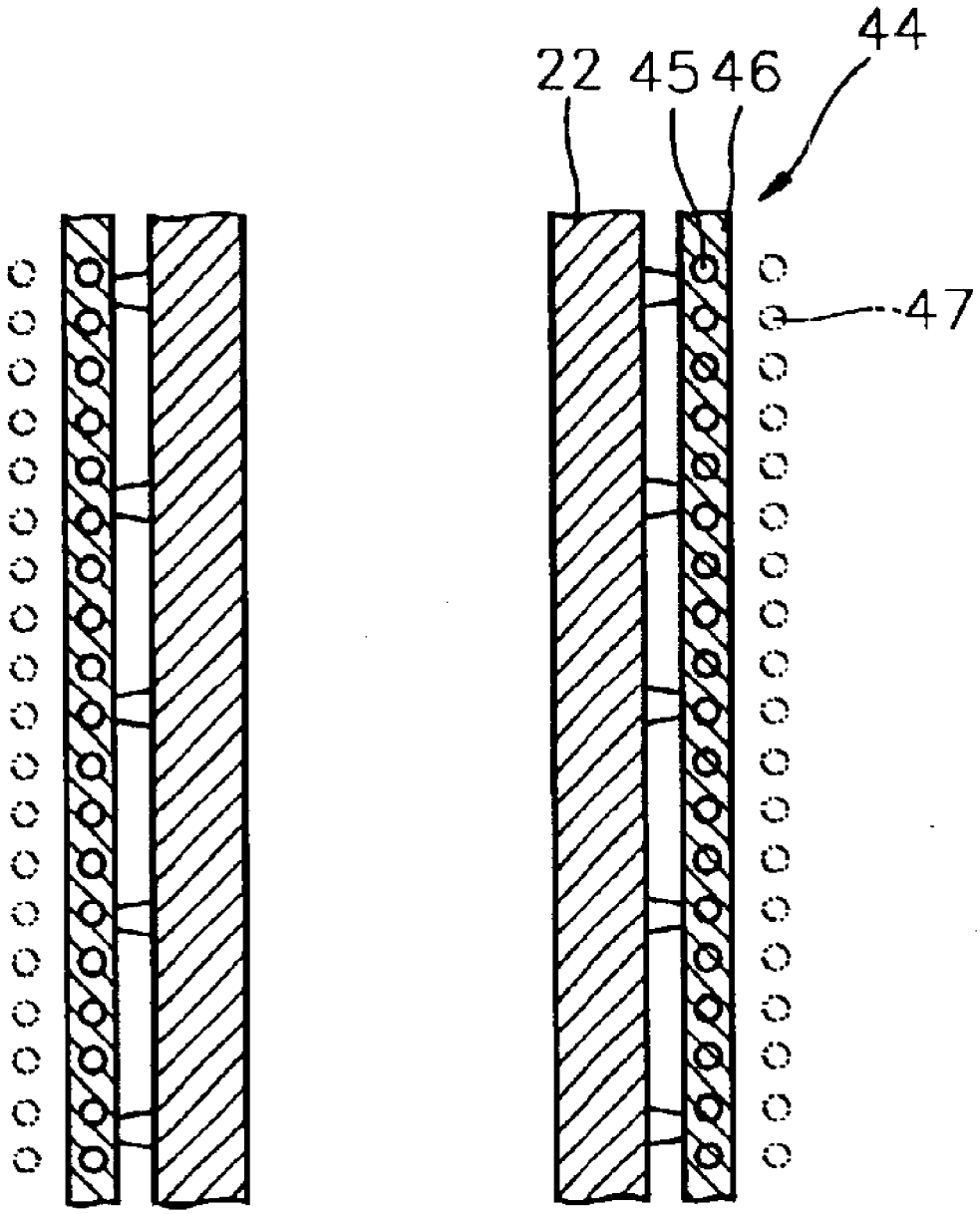
FIG. 3 is a sectional view of an example of a second sleeve used in a billet manufacturing apparatus according to the present invention.

The apparatus of the present invention may further comprise a temperature control element 44, which is installed around the second sleeve 22, as shown in FIG. 3. The temperature control element 44 is comprised of a cooler and a heater, which are installed in order around the second sleeve 22. In the embodiment of FIG. 3, a water jacket 46 containing a cooling water pipe 45 acts as the cooler and an electric heating coil 47 acts as the heater. The cooling water pipe 45 may be installed in a state of being buried in the second sleeve 22. Any coolers capable of cooling molten metals M contained in the second sleeve 22 may be used. Also, any heating units except for the electric heating coil 47 may be used. There are no particular limitations to the structure of the temperature control element 44, provided that the temperature control element 44 can adjust the temperature of molten metals or slurries. Molten metals contained in the second sleeve 22 can be cooled at an appropriate rate using the temperature control element 44.

As shown in FIG. 3, the temperature control element 44 may be installed around the entire second sleeve 22 or around the area in which the molten metals M are present.

The temperature control element 44 may cool the molten metals M contained in the second sleeve 22 until a solid fraction of the molten metals is 0.1–0.7. In this case, the cooling may be carried out at a rate of 0.2–5.0° C./sec, preferably 0.2–2.0° C./sec. As described above, the cooling may be carried out after the electromagnetic stirring or irrespective of the electromagnetic stirring, i.e., during the electromagnetic stirring. In addition, the cooling may be carried out simultaneously with the loading. The cooling may be carried out by any cooling units except for the temperature control element 44. That is, the molten metals M contained in the second sleeve 22 may be spontaneously cooled without the aid of the temperature control element 44.

The first and the second plungers 31, 32 move up and down like pistons in the first and the second sleeves 21, 22, respectively, while connected to cylinder units (no shown), which are in turn connected to controllers. While the electromagnetic stirring and cooling are carried out, i.e., while forming a slurry, the second sleeve 22 acts as a predetermined shaped vessel. When the second sleeve 22 is coupled with the first sleeve 21 after the completion of the slurry formation, the second plunger 32 pushes the slurry toward the first plunger 31. The first plunger 31 is operated in such a manner that when the second plunger 32 pushes a slurry, the first plunger 31 is fixed in the first sleeve 21 to form a predetermined sized billet, and when the billet is formed, the first plunger 31 withdraws from the billet to discharge the billet through the outlet vent 23.

Hereinafter, operation of the billet manufacturing apparatus containing the aforementioned structure according to an embodiment of the present invention will be described.

Turning to FIG. 2, the second sleeve 22 is hingedly connected to the first sleeve 21 at a predetermined angle, preferably 90 degrees. The lower part of the second sleeve 22 is closed by the second plunger 32 to allow the second sleeve 22 to act as a vessel for receiving the molten metals. The coil 11 of the stirring unit 1 applies an electromagnetic field having a predetermined frequency to the second sleeve 22 at a predetermined intensity. The coil 11 may apply an electromagnetic field with an intensity of 500 Gauss at 250 V, 60 Hz but is not limited thereto. Any electromagnetic fields capable of being used in the electromagnetic stirring for the purpose of rheocasting may be applied.

Metals M that have melted in a separate furnace are loaded via a loading unit 5 such as a ladle into the second sleeve 22 under an electromagnetic field. In this case, the furnace and the second sleeve may be directly connected to each other for directly loading the molten metals into the second sleeve. The molten metals may be loaded into the second sleeve 22 at a temperature of 100° C. above their liquidus temperature. The second sleeve 22 may be connected to a separate gas supply tube (not shown) for supplying an inert gas such as $N_2$ and Ar, thereby preventing the oxidation of the molten metals.

When the molten metals are loaded into the second sleeve 22 under the electromagnetic stirring, fine, crystalline particles are distributed throughout the second sleeve 22, where they rapidly grow. Thus, the formation of dendritic structure is prevented.

An electromagnetic field may be applied simultaneously with or in the middle of the loading of molten metals, as described above.

The application of an electromagnetic field may be sustained until a slurry is pressurized to form a billet, i.e., a solid fraction of the slurry is in the range of 0.001–0.7, preferably 0.001–0.4, and more preferably 0.001–0.1. The time required for accomplishing these solid fraction levels can be experimentally measured. The application of an electromagnetic field is carried out according to the experimentally measured time.

After completion or in the middle of application of an electromagnetic field, the molten metals in the second sleeve 22 are cooled at a predetermined rate until a solid fraction of the molten metals is in the range of 0.1–0.7. In this case, the cooling may be carried out at a rate of 0.2–5.0° C./sec, preferably 0.2–2.0° C./sec, as described above. The time ($t_2$) required for accomplishing the solid fraction of 0.1–0.7 can be determined by previous experiments.

After a semi-solid metallic slurry is manufactured, the second sleeve 22 is coupled with the fixed first sleeve 21 in a manner such that the second sleeve 22 moves at a predetermined angle, as shown in FIG. 4.

The second plunger 32 pushes the slurry toward the fixed first plunger 31 to form a billet B with a predetermined size. In this case, the pressurized slurry can be rapidly cooled by the cooling unit 41, which is installed around the first sleeve 21.

It is understood that the operation sequence can be altered. That is, after the second sleeve 22 is coupled with the first sleeve 21, the cooling may be carried out.

Figure 5:
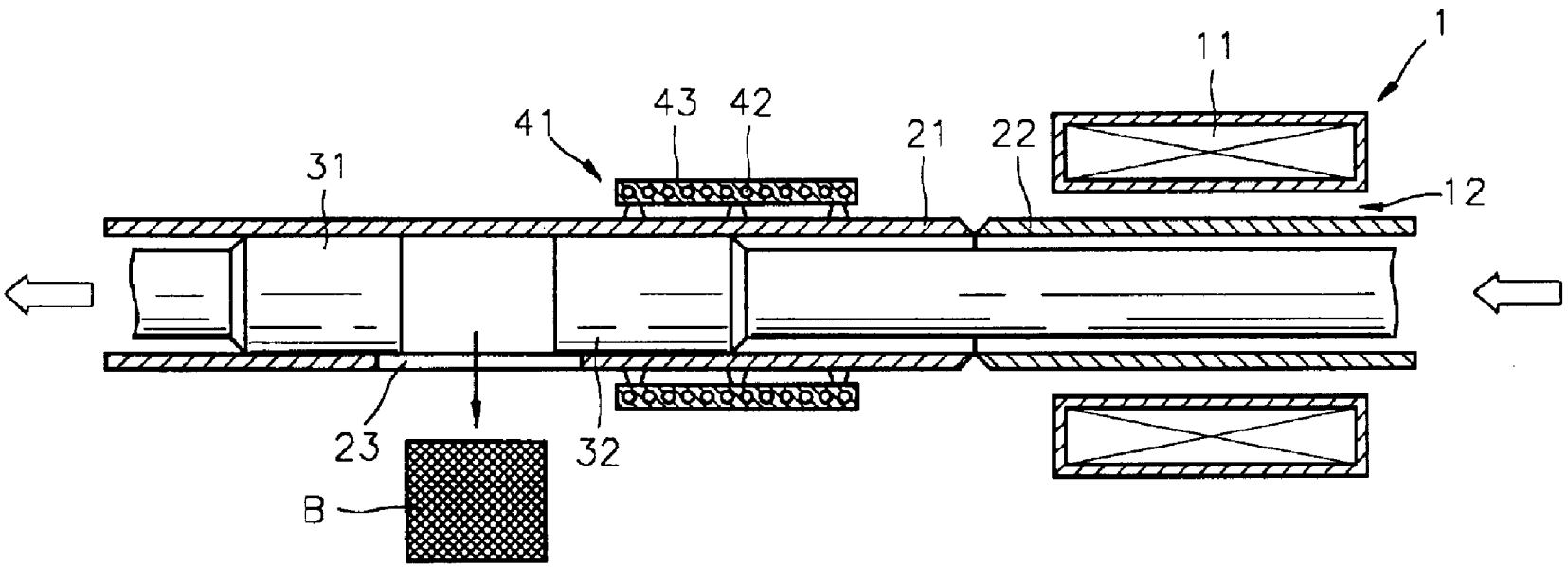
FIG. 5 illustrates a discharge of a billet for thixocasting manufactured using the apparatus shown in FIG. 2.

When the billet B is formed, significant strength is applied to the second plunger 32 to move the first plunger 31 and the billet B to the outlet vent 23, as shown in FIG. 5. The moved billet B is discharged through the outlet vent 23. The outlet vent 23 can have a size equal to the size of the billet B. However, it is preferable to use an outlet vent with a size larger than the billet B for discharging various sized billets. The transfer of the first plunger 31 may be accomplished by the pressurization of the second plunger 32 or by a separate cylinder device that is connected to the first plunger 31.

After the billet B is discharged, the first and the second plungers 31, 32 are returned to their original positions. Then, the second sleeve 22 moves back to a predetermined angle to act as a vessel capable of receiving molten metals, so that the aforementioned process may be repeated, as shown in FIG. 2. Therefore, billets with fine and uniform particle structures can be continuously discharged through the outlet vent 23.

Figure 6:
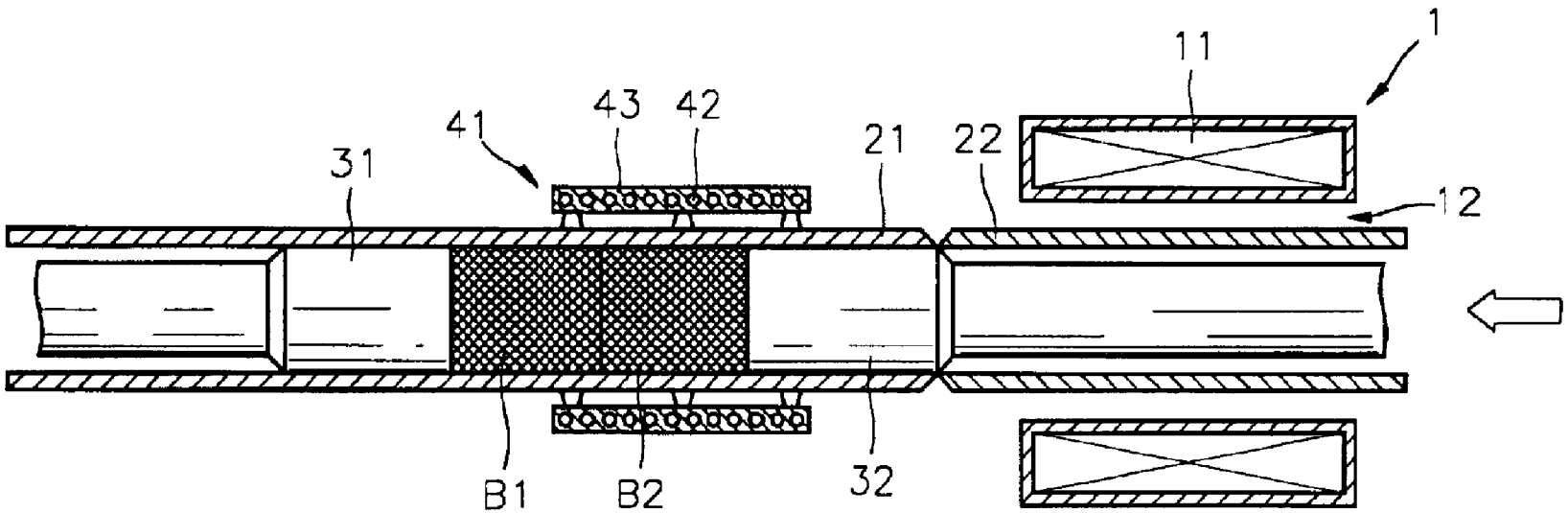
FIG. 6 illustrates the structure of an apparatus for manufacturing a billet for thixocasting according to another embodiment of the present invention.

Meanwhile, in a billet manufacturing apparatus according to another embodiment of the present invention as shown in FIG. 6, a plurality of billets are continuously manufactured and then discharged at a time, unlike the aforementioned embodiment. In this embodiment, there is no need to provide the first sleeve 21 with an outlet vent for discharging billets, unlike in the embodiment of FIGS. 2 to 5.

According to the embodiment of the billet manufacturing apparatus as shown in FIG. 6, when a first billet B1 is formed in the manner shown in FIGS. 2 to 4, significant strength is applied to the second plunger 32 toward the first plunger 31 for moving the first plunger 31 and the first billet B1. In this case, the moving of the first plunger 31 and the first billet B1 can be accomplished by the pressurization of the second plunger 32 or by separate means, as described above.

The first plunger 31 and the first billet B1 are moved at a distance sufficient to form a second billet B2 using the first billet B1 and the second plunger 32.

As described above, when the first billet B1 is formed, the second plunger 32 withdraws from the first billet B1 and then the second sleeve 22 moves back to a predetermined angle to act as a vessel for receiving molten metals. Then, when another semi-solid metal slurry is formed in the second sleeve 22, the second sleeve 22 again moves to a predetermined angle to couple with the first sleeve 21.

Next, when the second plunger 32 is pressurized in the direction of the first billet B1, the second billet B2 is formed between the first billet B1 and the second plunger 32. Preferably, in this case, the first plunger 31 is fixed in the first sleeve 21.

After the second billet B2 is formed, the aforementioned process is repeated to continuously manufacture a plurality of billets such as a third billet and a fourth billet.

By using the billet manufacturing apparatus according to the embodiment of the present invention as shown in FIG. 6, a plurality of high-quality billets can be continuously manufactured. Among the manufactured billets, neighboring billets may adhere to each other by melting. However, because the adhesion strength is very low, the adhered billets can be easily separated. The manufactured billets may be discharged after the first plunger 31 is removed from the first sleeve 21 or through a separate outlet vent (not shown) in the first sleeve 21.

The apparatus for manufacturing a billet for thixocasting according to the present invention can be widely used for rheocasting/thixocasting of various kinds of metals and alloys, for example, aluminum, magnesium, zinc, copper, iron, and an alloy thereof.

As apparent from the above description, an apparatus for manufacturing a billet for thixocasting according to the present invention provides the following effects.

First, alloys having a uniform, fine, and spherical particle structure can be manufactured.

Second, spherical particles can be formed within a short time through electromagnetic stirring at a temperature above the liquidus temperature of molten metals to thereby generate more nuclei at an inner vessel wall.

Third, manufactured alloys can achieve improved mechanical properties Fourth, the duration of electromagnetic stirring is greatly shortened, thereby conserving stirring energy.

Fifth, the simplified overall process and the reduced casting duration improve productivity.

Sixth, a plurality of billets can be continuously manufactured, thereby mass-producing billets.

Seventh, the process for manufacturing a high-quality billet for thixocasting can be simplified.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An apparatus for manufacturing a billet for thixocasting, the apparatus comprising:

a first sleeve;

a second sleeve for receiving molten metals, one end of the second sleeve being hingedly connected to one end of the first sleeve at a predetermined angle;

a stirring unit for applying an electromagnetic field to an inner portion of the second sleeve;

a second plunger that is inserted into the other end of the second sleeve to define a bottom of the second sleeve for receiving the molten metals and to pressurize a prepared slurry; and a first plunger that is inserted into the other end of the first sleeve, the first plunger being operated in such a manner that when the second plunger pushes the slurry toward the first plunger, the first plunger is fixed in the first sleeve, and when a billet with a predetermined size is formed, the first plunger withdraws from the billet.

2. The apparatus according to claim 1, wherein the first sleeve comprises an outlet vent for discharging the formed billet.

3. The apparatus according to claim 1, further comprising a cooling unit, which is installed around the first sleeve.

4. The apparatus according to claim 1, wherein the stirring unit applies the electromagnetic field to the second sleeve prior to loading the molten metals into the second sleeve.

5. The apparatus according to claim 1, wherein the stirring unit applies the electromagnetic field to the second sleeve simultaneously with loading the molten metals into the second sleeve.

6. The apparatus according to claim 1, wherein the stirring unit applies the electromagnetic field to the second sleeve in the middle of loading the molten metals into the second sleeve.

7. The apparatus according to claim 1, wherein the stirring unit applies the electromagnetic field to the second sleeve until the molten metals in the second sleeve have a solid fraction of 0.001–0.7.

8. The apparatus according to claim 7, wherein the stirring unit applies the electromagnetic field to the second sleeve until the molten metals in the second sleeve have a solid fraction of 0.001–0.4.

9. The apparatus according to claim 8, wherein the stirring unit applies the electromagnetic field to the second sleeve until the molten metals in the second sleeve have a solid fraction of 0.001–0.1.

10. The apparatus according to claim 1, wherein the molten metals in the second sleeve is cooled until the molten metals have a solid fraction of 0.1–0.7.

11. The apparatus according to claim 10, further comprising a temperature control element, which is installed around the second sleeve to cool the molten metals in the second sleeve.

12. The apparatus according to claim 11, wherein the temperature control element comprises at least one of a cooler and a heater, which are installed around the second sleeve.

13. The apparatus according to claim 11, wherein the temperature control element cools the molten metals in the second sleeve at a rate of 0.2–5.0° C./sec.

14. The apparatus according to claim 13, wherein the temperature control element cools the molten metals in the second sleeve at a rate of 0.2–2.0° C./sec.

* * * * *